US008502127B2

(12) United States Patent
McNeish

(10) Patent No.: US 8,502,127 B2
(45) Date of Patent: Aug. 6, 2013

(54) APPARATUS FOR GUIDING A RIFLE-LAUNCHED PROJECTILE

(75) Inventor: Allister McNeish, Georgetown, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 13/547,461

(22) Filed: Jul. 12, 2012

(65) Prior Publication Data

US 2013/0048777 A1 Feb. 28, 2013

Related U.S. Application Data

(60) Provisional application No. 61/507,174, filed on Jul. 13, 2011.

(51) Int. Cl.
*F42B 15/01* (2006.01)

(52) U.S. Cl.
USPC ..... 244/3.16; 244/3.1; 244/3.15

(58) Field of Classification Search
USPC ..... 244/3.1–3.19; 356/138, 140, 141.2, 356/141.4, 141.5
See application file for complete search history.

(56) References Cited

U.S. PATENT DOCUMENTS

| | | | | |
|---|---|---|---|---|
| 3,779,492 | A * | 12/1973 | Grumet | 244/3.17 |
| 4,231,533 | A * | 11/1980 | Durig | 244/3.16 |
| 4,277,137 | A * | 7/1981 | Upatnieks et al. | 244/3.17 |
| 4,516,743 | A * | 5/1985 | Sweeney et al. | 244/3.13 |
| 4,733,609 | A * | 3/1988 | Goodwin et al. | 244/3.16 |
| 5,029,220 | A * | 7/1991 | Juday | 244/3.17 |
| 5,129,309 | A * | 7/1992 | Lecuyer | 244/3.11 |
| 5,601,255 | A * | 2/1997 | Romer et al. | 244/3.13 |
| 5,661,555 | A * | 8/1997 | Romer et al. | 244/3.13 |
| 6,851,645 | B1 * | 2/2005 | Williams et al. | 244/3.16 |
| 7,127,138 | B2 * | 10/2006 | Efimov et al. | 244/3.16 |
| 7,185,845 | B1 * | 3/2007 | Hartman et al. | 244/3.16 |

* cited by examiner

*Primary Examiner* — Bernarr Gregory
(74) *Attorney, Agent, or Firm* — Yudell Isidore Ng Russell; Antony P. Ng; Daniel J. Long

(57) ABSTRACT

An optical guidance system for guiding a projectile is disclosed. The optical guidance system includes a laser, a first and second cylindrical holographic lenses and a variable zoom lens. The laser generates a laser beam, and the first and second cylindrical holographic lenses transform the laser beam into a x-direction and y-direction scan patterns, respectively. The variable zoom lens projects the x-direction and y-direction scan patterns in the form of multiple scan fields, each within a scan corridor, in order to guide a projectile along a flight path towards a target.

5 Claims, 5 Drawing Sheets

APPARATUS FOR GUIDING A RIFLE-LAUNCHED PROJECTILE

PRIORITY CLAIM

The present application claims priority under 35 U.S.C. §119(e)(1) to provisional application No. 61/507,174 filed on Jul. 13, 2011, the contents of which are incorporated herein by reference.

BACKGROUND OF THE INVENTION

1. Technical Field

The present invention relates to guided projectiles in general, and in particular to an apparatus for guiding a rifle-launched projectile.

2. Description of Related Art

The ability of a sniper to eliminate an enemy target at distances well over one mile away has a paralyzing effect on an adversarial combat force. However, many combat units do not have the luxury of full-time sniper support. Given the tempo of operations common in modern asymmetric warfare, it is often too late to deploy sniper support by the time an engagement has begun.

One way to address the problem of limited sniper availability is to enable any solder within a squad equipped with a squad-level weapon to have the shooting accuracy comparable to a trained sniper. For example, small caliber weapons, such as rifles, can be furnished with self-guided projectiles. Some approaches to imparting guidance on projectiles include spinning a projectile or de-spinning a portion of the projectile to provide aerodynamic stability. Other approaches involve the usage of drag inducing control surfaces. However, these approaches have been proven impractical to realize within the size, weight and cost constraints of small arms munitions.

Consequently, it would be desirable to provide an improved guided projectile suitable for use in small caliber weapons.

SUMMARY OF THE INVENTION

In accordance with a preferred embodiment of the present invention, an optical guidance system includes a laser, a first and second cylindrical holographic lenses and a variable zoom lens. The laser generates a laser beam, and the first and second cylindrical holographic lenses transform the laser beam into a x-direction and y-direction scan patterns, respectively. The variable zoom lens projects the x-direction and y-direction scan patterns in the form of multiple scan fields, each within a scan corridor, in order to guide a projectile along a flight path towards a target.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
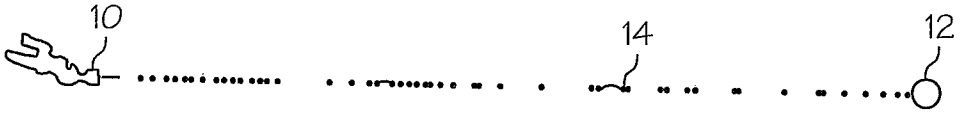
FIG. 1 is a top view of a shooter firing a bullet from a rifle at a distant target, in which a preferred embodiment of the present invention can be incorporated.

Referring now to the drawings and in particular to FIG. 1, there is illustrated a top view of a shooter firing a bullet from a rifle at a target located some distance away, in which a preferred embodiment of the present invention can be incorporated. As shown, a shooter 10 acquires a target 12 optically using a scope mounted on shooter 10's rifle. After firing a bullet, shooter 10 uses an optical guidance system incorporated within the scope to guide the bullet along a flight path 14 towards target 12. After the bullet has exited the rifle, shooter 10 continues to train on target 12 while the bullet makes any required adjustments to its flight in order for the bullet to hit target 12 with a high-degree of accuracy. The bullet may be, for example, a 0.50 caliber round that can be guided up to ranges of 2 km with a better than 10 cm degrees of accuracy. Thus, the optical guidance system can provide sniper-like capabilities to any shooter.

Figure 2:
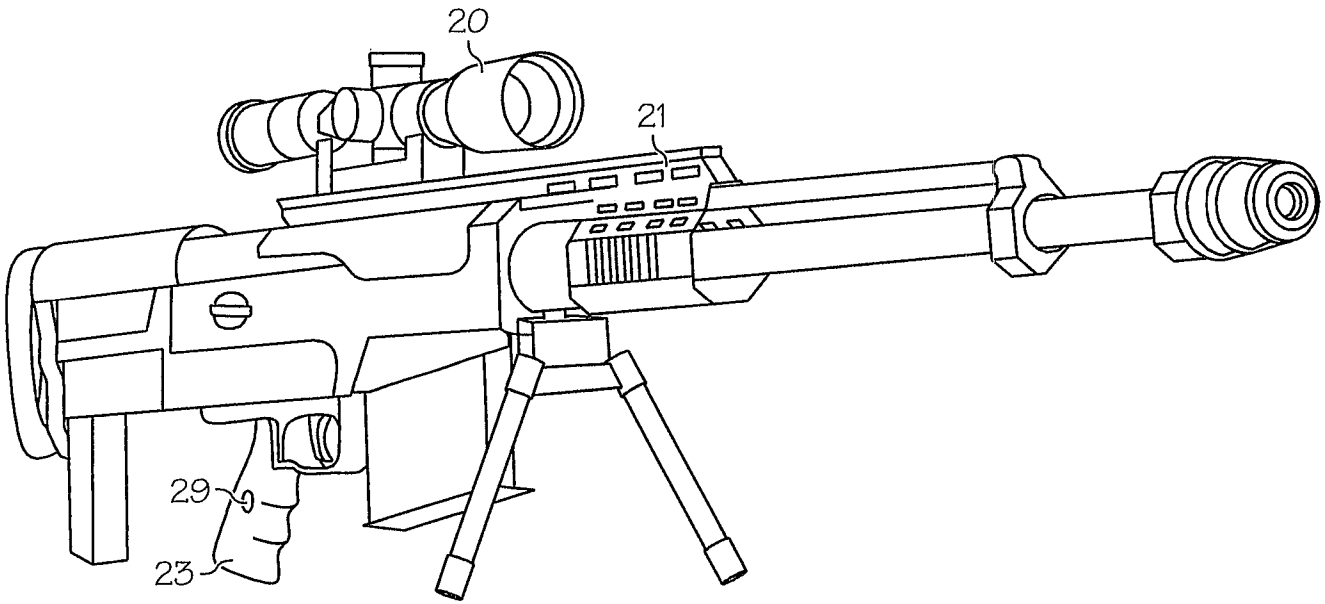
FIG. 2 is an isometric view of a scope having an optical guidance system, in accordance with a preferred embodiment of the present invention.

With reference now to FIG. 2, there is illustrated an isometric view of a scope having an optical guidance system, in accordance with a preferred embodiment of the present invention. As shown, a scope 20 is mounted on a rifle 21 that generally includes a barrel, a receiver and a stock. A distant target can be acquired by a shooter using scope 20 via a normal optical sighting process. After a bullet has been fired from rifle 21, scope 20 allows a shooter to guide the bullet along its flight path towards the distant target via its optical guidance system. Preferably, a switch 29 located on a grip 23 of rifle 21 can be utilized to activate the optical guidance system within scope 20 in order to guide a speeding bullet after it has been fired from rifle 21.

Figure 3:
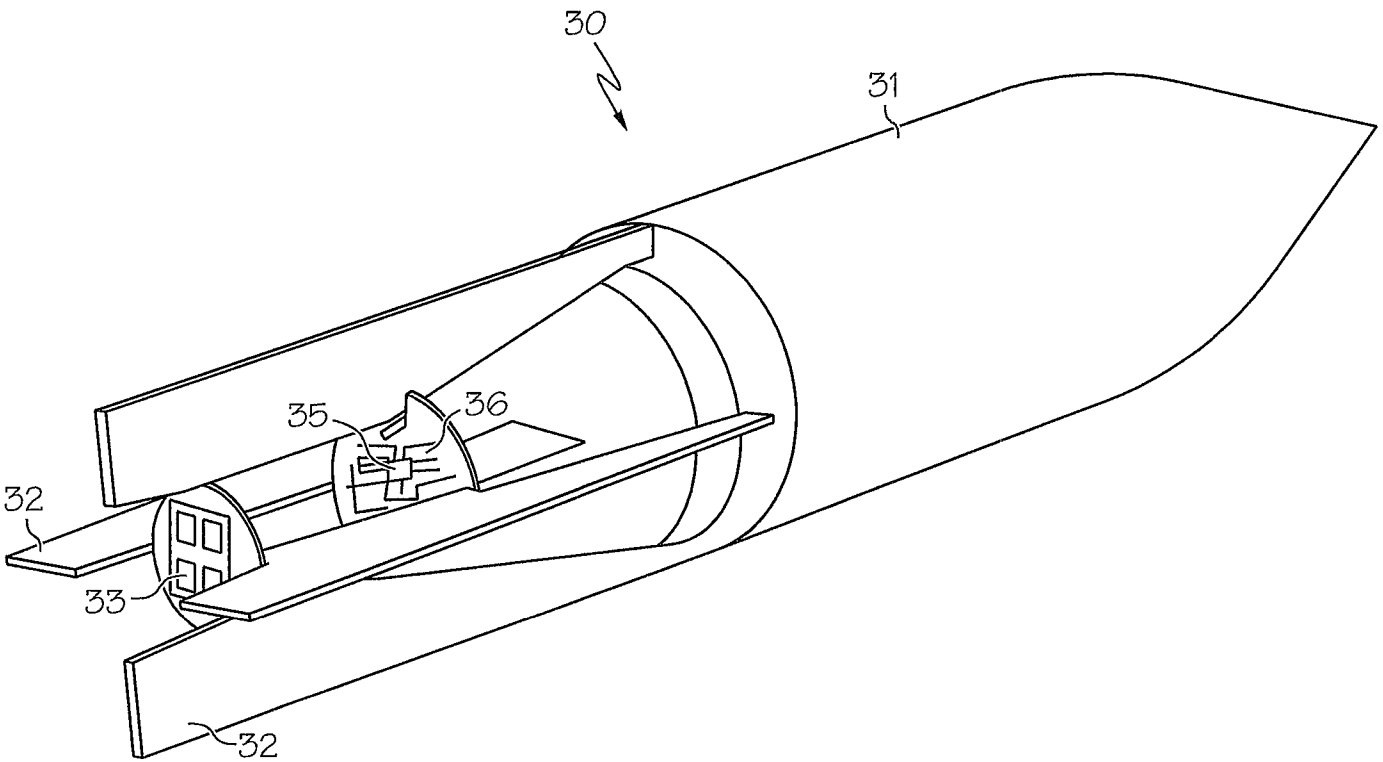
FIG. 3 is an isometric view of a bullet that is capable of being guided by the optical guidance system from FIG. 2, in accordance with a preferred embodiment of the present invention.

Referring now to FIG. 3, there is illustrated an isometric view of a bullet capable of being guided by the optical guidance system within scope 20 from FIG. 2, in accordance with a preferred embodiment of the present invention. As shown, a bullet 30 includes a body 31 located at the front of bullet 30, and a set of fins 32 located at the rear of bullet 30. Fins 32 are moveable by a set of actuators 36 that are preferably piezoelectric actuators. Bullet 30 includes an optical sensor 33 and processing circuitry 35. Optical sensor 33 is preferably located at the rear end of bullet 30. Bullet 30 is also fitted with a roll gyro (not shown) for bullet 30 to ascertain an up direction. After processing all optical information gathered by optical sensor 33 and directional information gathered by the roll gyro, processing circuitry 35 utilizes those optical and directional information to control fins 32 via actuators 36.

Figure 4:
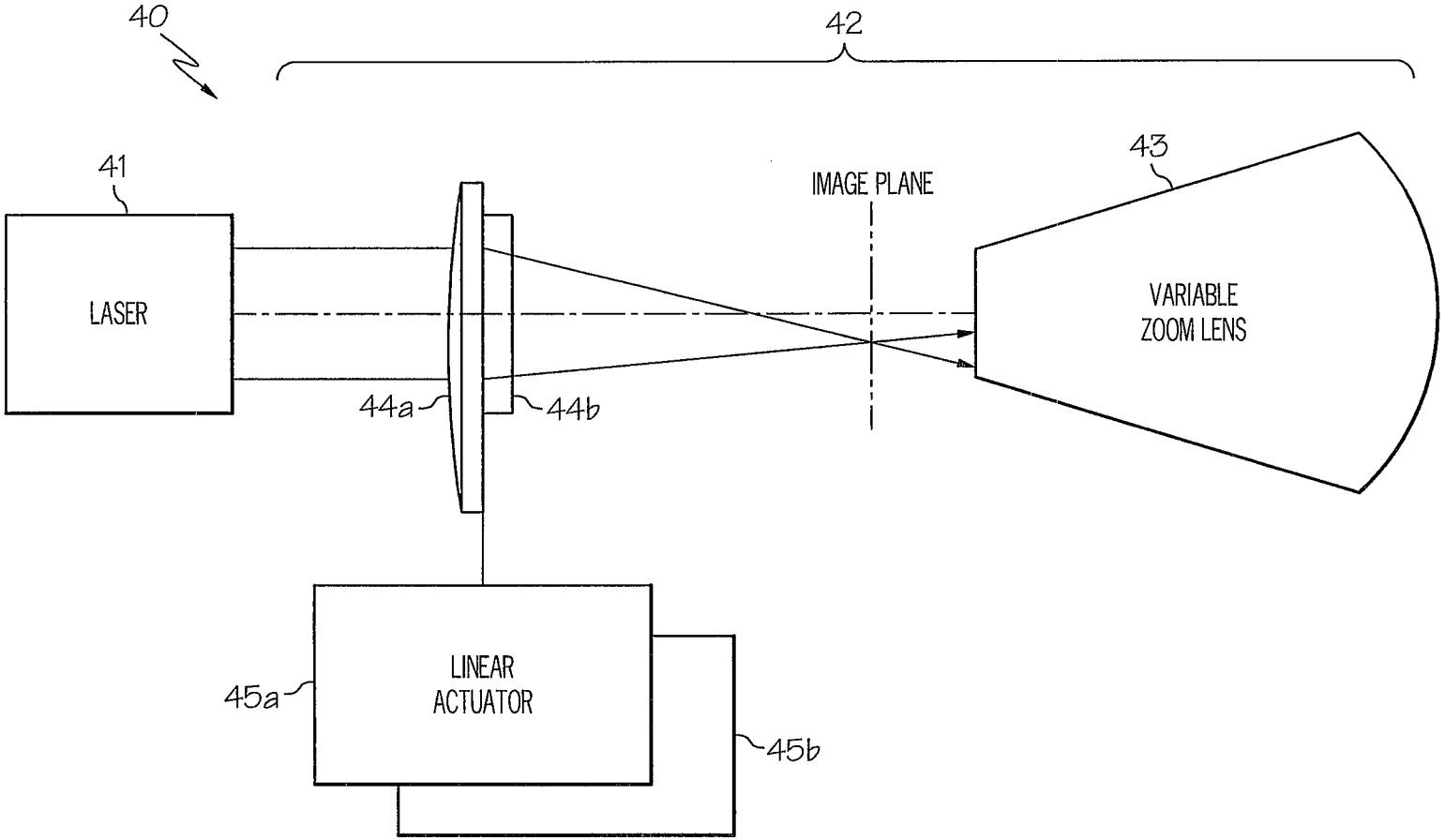
FIG. 4 is a block diagram of the optical guidance system from FIG. 2, in accordance with a preferred embodiment of the present invention.

With reference now to FIG. 4, there is illustrated a block diagram of an optical guidance system, in accordance with a preferred embodiment of the present invention. As shown, an optical guidance system 40 includes a laser 41 and a beam projector 42. Laser 41 may be a laser diode or the like that is capable of producing a low-power laser beam. Beam projector 42 should be low SWAP, ideally disposable if necessary. Thus, beam projector 42 should be made up of holographic optical elements, reticles (because of their light weight) and piezoelectric actuators (because of their low power consumption). Preferably, beam projector 42 is made up of a pair of cylindrical holographic lenses 44*a*, 44*b*, a pair of programmable linear actuators 45*a*, 45*b* and a variable zoom lens 43.

In conjunction with laser 41, beam projector 42 can generate a set of scan fields that can be projected towards a distant target via variable zoom lens 43. Each scan field includes a laser scan along a y-direction followed by a laser scan along a x-direction (or vice versa). Each scan is a fore and aft scan to reposition cylindrical holographic lenses 44*a*, 44*b* for the next scan event. The scans are performed by traversing cylindrical holographic lenses 44*a*, 44*b* through a laser beam from laser 41, first in the y-direction forward and back, and then in the x-direction forward and back. Specifically, linear actuator 45*a* controls the movements of cylindrical holographic lens 44*a* to convert the laser beam from laser 41 to a laser scan in the y-direction. Similarly, linear actuator 45*b* controls the movements of cylindrical holographic lens 44*b* to convert the laser beam from laser 41 in the x-direction.

Optical guidance system 40 provides a wide angle capture corridor at the initial launch of a bullet, followed by a progressively narrowing guidance corridor as the bullet travels down range towards a target. A zoom ratio of 10:1 is relatively easy to obtain, providing a corridor angle at the initial launch of the bullet being ten times larger than that projected during terminal guidance. Zooming does not affect the timing of guidance, so optical guidance system 40 is agnostic to the corridor size.

The modulation frequency of laser 41 can be changed between two values for the y-direction scans and x-direction scans, or timing maintained at a bullet capable of being guided via multiple scan fields. The determination of scan fields at the bullet can be accomplished by changing the laser pulse repetition frequency between two selections, one for y-direction scans and one for x-direction scans.

Figure 5B:
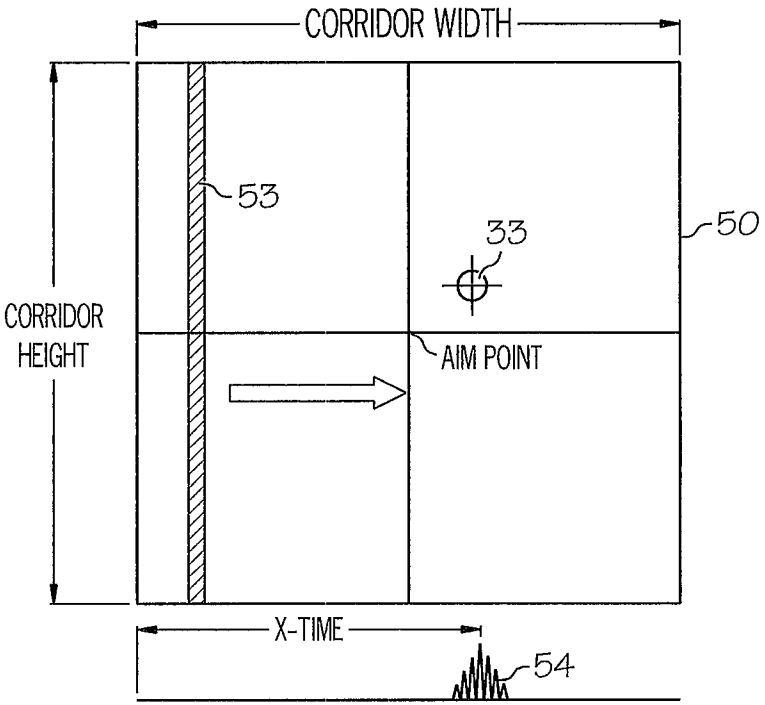
FIG. 5*a*-5*b* shows two scan fields that make up a scan corridor.
Figure 5A:
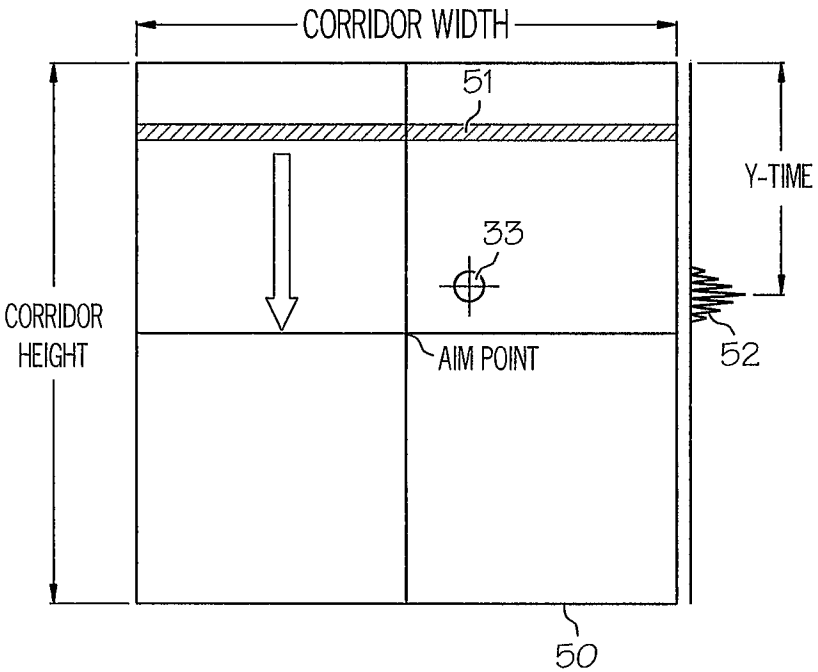

Referring now to FIGS. 5*a*-5*b*, there are illustrated two scan fields that make up a scan corridor (guidance frame). In FIG. 5*a*, a scan line 51 travels up and down (i.e., a y-direction scan) within a scan window 50. As scan line 51 intersects an optical sensor of a speeding bullet (such as optical sensor 33 of bullet 30 from FIG. 3), multiple laser pulses 52 are detected by the optical sensor of the speeding bullet. The difference between the time that laser pulses 52 are detected by the speeding bullet and the start time of the y-direction scan yields a measurement of the position of the speeding bullet in the y-direction within scan corridor 50. In FIG. 5*b*, a scan line 53 travels left and right (i.e., a x-direction scan) within a scan window 50. As scan line 53 intersects the optical sensor of a speeding bullet, multiple laser pulses 54 are detected by the optical sensor of the speeding bullet. The difference between the time that laser pulses 54 are detected by the speeding bullet and the start time of the x-direction scan yields a measurement of the position of the speeding bullet in the x-direction within scan corridor 50.

After the position of the speeding bullet in the x-direction and y-direction within a scan corridor have been ascertained, the distance of the speeding bullet in relation to the center point (aim point or cross-hair) of scan corridor 50 can be determined. As this point, the guidance mechanism within the speeding bullet will make certain adjustment to direct the speeding bullet to travel along the center point of scan corridor 50. Thus, as long as a shooter trains the center point of scan corridor 50 at the intended target after the bullet has been fired, the bullet should be able to make its way towards the intended target.

The separation of the x-direction scan and the y-direction scan can be performed in the speeding bullet by maintaining a field clock that is synchronized at launch or by modulating the laser pulsing to different frequencies from the x or y scan fields.

Optical guidance system 40 operates at a fixed frame rate and a constant update rate having an inter-update time $T_U$ of $1/F_f$, where $F_f$ is frame rate in Hz. The duration of the optical sensor illumination $T_R$ is $$T_f/R_A+(A_R T_f)/(R\theta_c)$$

where $T_f$ is field time in seconds
$R_A$ is aspect ratio
$A_R$ is optical sensor aperture in mm
R is range in km
$\theta_c$ is corridor angle in mR Most likely, the second part of the above-mentioned equation that represents the transit time across the optical sensor aperture can be ignored because it is very small.

The number of laser pulses $N_p$ within the optical sensor illumination time $T_R$ is $T_R F_L$. This number needs to be 3 or more in order to allow for an estimation of the position more accurate than that given by $T_R$ alone.

Assuming that laser 41's pulse repetition frequency (PRF) is large enough to provide multiple laser pulses per optical sensor illumination time, the temporal resolution will be less than the inter-pulse time $1/F_L$, thus, the temporal resolution $\Delta T$ will be at least $$T_R/Np.$$

$$\text{The angular resolution } \Delta\theta = (\theta_c)/(T_f/\Delta T),$$
$$= (\theta_c/\Delta T)/(T_f)$$

where $\theta_c$ is corridor angle in mR
$T_f$ is field time in seconds
$\Delta T$ is the temporal resolution If the target is taken to be a shape that is 0.5 m wide by 1.5 m tall at a range of 3 km, the subtended angle (azimuth) is given by $\theta_x$=0.5/3,000=170 μR. Assuming a resolution accuracy of less than half the above-mentioned amount, the required resolution $\Delta\theta$ will be 50 μR. Given an aspect ratio, $R_A$=50 and Np=5, then the corridor angle $\theta_c$ needs to be 12.5 mR at 3 km with a laser PRF of $F_L$=50 kHz. Given a zoom capability of $R_z$=10, the corridor angle $\theta_c$ can be 7 degrees wide at trigger pull.

The illuminated area at maximum range is 12.5 mR×250 μR×3,000×3,000=28 $m^2$. Given a detectable threshold laser intensity of $1\times10^{-4}$ W/$cm^2$ with allowance for scintillation fade, the laser peak power needs to be 28 W. With a pulse width $T_p$ of 100 nS, and a PRF of 50 kHz, the average laser power $P_L$ needs to be 70 mW.

Given that a guided bullet has range information when launched and can compute an approximate dynamic distance to the target impact, the guided bullet may or may not be necessary to guide all the way. In this way, the flight dynamics of the guided bullet are preserved during most of its flight with a disturbance to it happening for a short duration before hitting a target and over a distance minimally necessary to provide an accurate hit.

Figure 6:
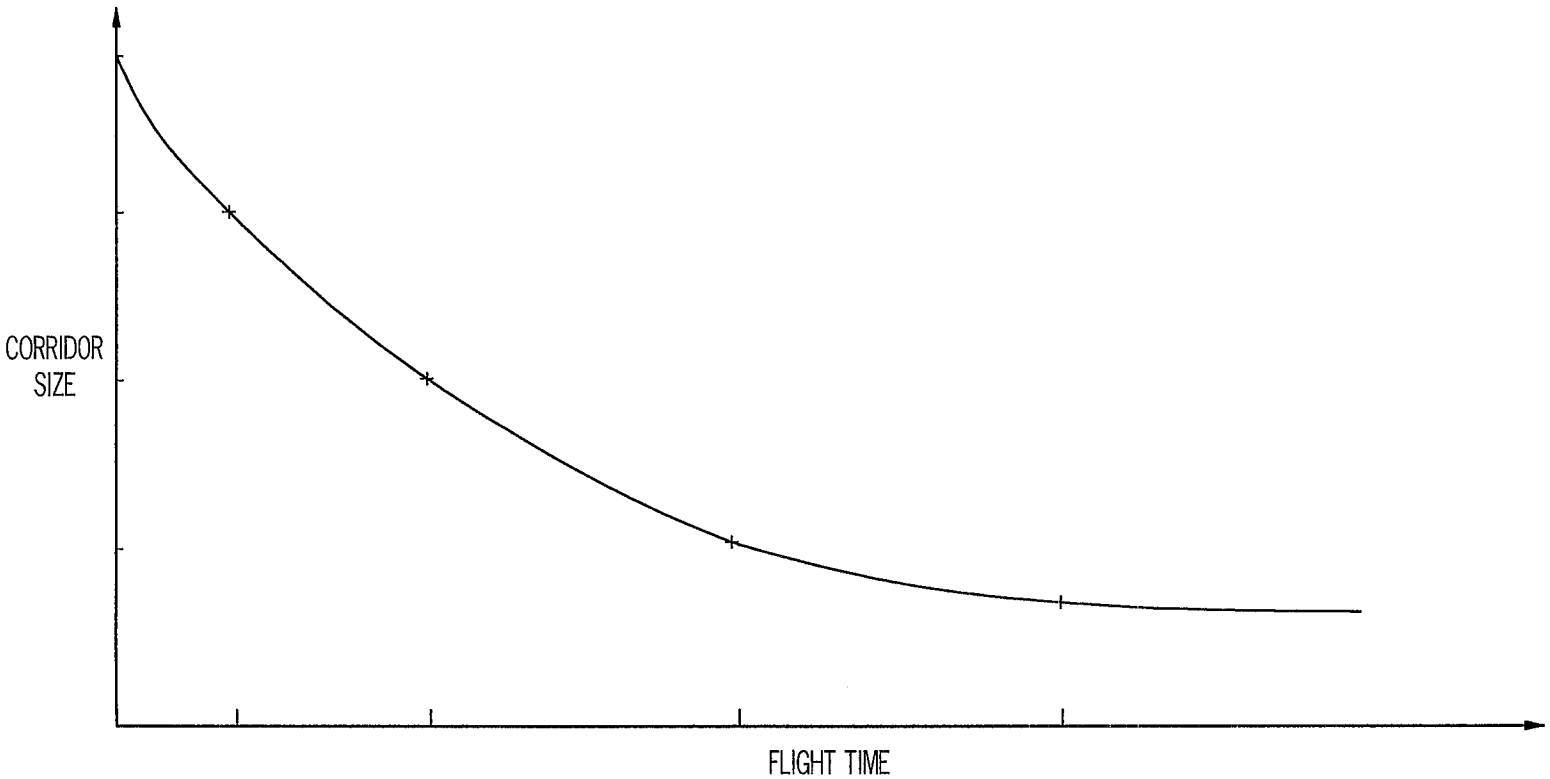
FIG. 6 shows the rate at which the corridor angle is collapsed during the flight of a speeding bullet.

With reference now to FIG. 6, there is illustrated the rate at which the corridor angle is collapsed during flight. The goal is to maintain a relatively constant irradiance at the optical sensor within the bullet during flight, reducing its dynamic range requirements. While the effect of zoom is to reduce the angular scan rate across the optical sensor as the corridor collapses, the update rate remains constant because everything remains in proportion.

In the example above, the parameters necessary to achieve a 50 gR aiming accuracy with optical guidance system 40 show that laser 41 with a PRF $F_L$ of 50 kHz, a pulse width $T_p$ of 100 ns, a peak power of 28 W and an average power of 70 mW can be made to yield this performance with a 10:1 zoom, a frame rate $F_f$ of 100 Hz and a fan beam aspect ration of 50:1.

As has been described, the present invention provides an optical guidance system for guiding a rifle-launched projectile. The optical guidance system uses a line-of-sight method that relies on the projection of a scanning beam pattern centered on the target within which a projectile can determine its position relative to an aim point accordingly. A rearward-looking optical sensor in the traveling projectile detects the passage of the scan pattern across the optical sensor and uses the timing information deduced to produce a set of guidance signals. The optical guidance system allows an average marksman to exhibit expert-level shooting skills.

While the invention has been particularly shown and described with reference to a preferred embodiment, it will be understood by those skilled in the art that various changes in form and detail may be made therein without departing from the spirit and scope of the invention.

What is claimed is:

1. An apparatus for guiding a projectile, said apparatus comprising:

a laser for generating a laser beam;

a first cylindrical holographic lens for transforming said laser beam into a x-direction scan pattern;

a second cylindrical holographic lens for transforming said laser beam into a y-direction scan pattern; and a variable zoom lens for combining said x-direction and y-direction scan patterns to generate a plurality of scan fields, each within a scan corridor, in order to guide a projectile along a flight path towards a target.

2. The apparatus of claim 1, wherein said apparatus further includes a first linear actuator for moving said first cylindrical holographic lens.

3. The apparatus of claim 2, wherein said first linear actuator is a piezoelectric actuator.

4. The apparatus of claim 1, wherein said apparatus further includes a second linear actuator for moving said second cylindrical holographic lens.

5. The apparatus of claim 4, wherein said second linear actuator is a piezoelectric actuator.

* * * * *